US007238084B2

(12) United States Patent
Kim

(10) Patent No.: US 7,238,084 B2
(45) Date of Patent: Jul. 3, 2007

(54) CHEMICAL MECHANICAL POLISHING APPARATUS AND CHEMICAL MECHANICAL POLISHING METHOD USING THE SAME

(75) Inventor: Wan-Shick Kim, Yongin (KR)

(73) Assignee: Dongbu Electronics Co., Ltd., Seoul (KR)

( * ) Notice: Subject to any disclaimer, the term of this patent is extended or adjusted under 35 U.S.C. 154(b) by 0 days.

(21) Appl. No.: 11/265,611

(22) Filed: Nov. 1, 2005

(65) Prior Publication Data

US 2006/0094338 A1 May 4, 2006

(30) Foreign Application Priority Data

Nov. 1, 2004 (KR) ..... 10-2004-0087868

(51) Int. Cl.
*B24B 49/00* (2006.01)

(52) U.S. Cl. ..... 451/7; 451/41; 451/53; 451/287

(58) Field of Classification Search ..... 451/7, 451/41, 285, 287, 53; 438/692
See application file for complete search history.

(56) References Cited

U.S. PATENT DOCUMENTS 4,508,161 A * 4/1985 Holden ..... 165/80.1
4,537,244 A * 8/1985 Holden ..... 165/46
5,980,363 A * 11/1999 Meikle et al. ..... 451/41
6,705,923 B2 * 3/2004 Liu et al. ..... 451/7
6,736,952 B2 * 5/2004 Emesh et al. ..... 205/81
2004/0248430 A1 * 12/2004 Barber et al. ..... 438/795

FOREIGN PATENT DOCUMENTS

KR 2001-0062114 7/2001

OTHER PUBLICATIONS

Monoocher Birang, Ramin Emami, Shijian Li and Fred C. Redeker; Thermal Preparatory State Regulation for Fixed Abrasive Product; English Abstract of Korean Patent Publication; 1020010062114 A; Jul. 7, 2001; Korean Intellectual Property Office, Republic of Korea.

* cited by examiner

*Primary Examiner*—Eileen P. Morgan
(74) *Attorney, Agent, or Firm*—Andrew D. Fortney

(57) ABSTRACT

Polishing uniformity in a CMP process may be improved due to an improvement in the temperature uniformity of a polishing surface, when a wafer is polished by a CMP apparatus including a polishing head for holding the wafer, a platen, a polishing pad at a top of the platen so as to polish the wafer, and a heat conduction medium on or in the polishing pad and configured to diffuse heat of the polishing pad such that the temperature distribution of the polishing pad may become substantially uniform.

22 Claims, 2 Drawing Sheets

CHEMICAL MECHANICAL POLISHING APPARATUS AND CHEMICAL MECHANICAL POLISHING METHOD USING THE SAME

CROSS-REFERENCE TO RELATED APPLICATION

This application claims priority to and the benefit of Korean Patent Application No. 10-2004-0087868, filed in the Korean Intellectual Property Office on Nov. 1, 2004, the entire contents of which are incorporated herein by reference.

BACKGROUND OF THE INVENTION (a) Field of the Invention

The present invention relates to a chemical mechanical polishing (CMP) apparatus and a CMP method using the same.

(b) Description of the Related Art

Recently, with the high integration of semiconductor devices, the structure thereof has been multi-layered. Accordingly, a polishing process for planarizing layers of a semiconductor wafer is typically included in a fabrication process of the semiconductor devices. As such a polishing process, a chemical mechanical polishing (CMP) process is widely adopted.

The CMP process is a process for polishing a surface of a wafer coated with an oxide or metal such as tungsten, copper, etc., by using mechanical friction as well as a chemical abrasive.

Here, mechanical polishing implies polishing a surface of the wafer using friction between a polishing pad and the surface of the wafer by rotating the wafer when it is fixed on a rotating polishing head, with the wafer pressed against the polishing pad (for example, made of polyurethane or polytex) that is attached on a platen of stainless steel or ceramic. In addition, chemical polishing implies polishing the surface of the wafer using slurry supplied between the polishing pad and the wafer as a chemical abrasive.

According to such a CMP process, in order to control polishing uniformity of the wafer, the rotation speed of the platen and/or the polishing head is controlled as is the pressure applied to the polishing head.

In addition, recent attempts have been made to improve the polishing uniformity by controlling the pressure applied to the polishing head such that the wafer may receive different pressures depending on zones.

However, such efforts to improve polishing uniformity have been satisfactory only to a limited degree, for the following reasons.

During the CMP process, heat is generated by the friction between a wafer and a polishing pad, and more heat is generated where a friction area is larger.

By measuring a temperature distribution using an infrared (IR) camera, a temperature of a central region of a wafer is found to be higher than a temperature of a peripheral region thereof, which is believed to be because the central region of the wafer has a wider friction area than does the peripheral region.

According to such a CMP process, the removal rate tends to increase as the temperature increases. Such a phenomenon results in a bigger difference in the removal rate between the central region and the peripheral region as the wafer becomes larger in diameter. Furthermore, planarization of a metal layer for forming a metal line produces greater frictional heat in comparison with planarization of an oxide layer, and in this case the polishing uniformity becomes worse.

In order to solve such a problem, attempts have been made to disperse the frictional heat by, for example, installing a coolant pipe in a platen, or by supplying slurries of different temperatures at multiple points. However, such a conventional method may only provide a mere effect of lowering the temperature of the platen, rather than enabling the temperature distribution of a wafer surface to be more uniform. Therefore, polishing uniformity that may be achieved by such a conventional method is not sufficient for an improvement of the polishing uniformity.

The above information disclosed in this Background section is only for enhancement of understanding of the background of the invention, and therefore, it may contain information that does not form knowledge or prior art that may be already known in this or any other country to a person of ordinary skill in the art.

SUMMARY OF THE INVENTION

The present invention has been made in an effort to provide a CMP apparatus and method having advantages of improving polishing uniformity by controlling heat generated during a CMP process such that a polishing pad may have a uniform temperature distribution.

An exemplary CMP apparatus according to an embodiment of the present invention includes: a polishing head for holding a wafer; a platen; a polishing pad on or at the top of the platen so as to polish the wafer; and a heat conduction medium on, in or at the polishing pad for diffusing heat of (or transferring heat from or in) the polishing pad such that a temperature distribution of the polishing pad may become substantially uniform. Thus, the heat conduction medium may be configured to provide the polishing pad with a substantially uniform temperature distribution.

The heat conduction medium may include a plurality of metal lines having a thermal conductivity that is higher than that of the polishing pad. In this case, the plurality of metal lines may include copper (Cu) or gold (Au).

When the polishing pad is a single pad, the plurality of metal lines may be formed at or on the bottom side of the polishing pad, such that corrosion by cleaning water or a chemical such as one in a slurry may be prevented.

In addition, when the polishing pad is a stacked pad having a plurality of constituent pads including a top pad and a bottom pad, the plurality of metal lines may be formed at or on the bottom side of the top pad, at or on the bottom side of the bottom pad, or at a place or location between the top pad and the bottom pad where the plurality of constituent pads are adhered to one another.

According to such a CMP apparatus, the heat generated at a central region of a wafer may be rapidly conducted to a peripheral region thereof, and thus a temperature distribution in or of the polishing pad may be substantially uniform.

An exemplary CMP method according to an embodiment of the present invention is a CMP method using a CMP apparatus including a polishing head for holding a wafer and a platen for holding a polishing pad for polishing the wafer.

According to a CMP method according to an exemplary embodiment of the present invention, a first wafer to be polished may be mounted at or on the polishing head of the CMP apparatus. In addition, a first polishing pad may be mounted at or on the platen, wherein the first polishing pad further includes a first heat conduction medium for diffusing heat of the first polishing pad such that a temperature distribution of the first polishing pad may become substantially uniform. Then, a CMP process is applied to the first wafer by polishing the first wafer with the first polishing pad.

Subsequently, the first wafer is removed from the polishing head of the CMP apparatus, and the first polishing pad may be removed from the platen of the CMP apparatus.

Following this, a second wafer to be polished may be mounted at or on the polishing head of the CMP apparatus, and a second polishing pad may be mounted at or on the platen, wherein the second polishing pad further includes a second heat conduction medium for diffusing heat of the second polishing pad such that a temperature distribution of the second polishing pad may become substantially uniform. Subsequently, a CMP process is applied to the second wafer by polishing the second wafer with the second polishing pad. (Alternatively, the second wafer may be polished with the first polishing pad.) The first and second heat conduction media may be differently formed depending on the object to be polished in the first and second wafers. The first and second heat conduction media may comprise a plurality of metal lines having higher thermal conductivity than the first and second polishing pads, respectively. Alternatively, either or both of the first and second heat conduction media may comprise a substantially uniformly distributed thermal conductor, such as a metal coating.

The first and second heat conduction media may be the same or different in at least one of arrangements, structures, materials, and line widths of the plurality of metal lines, depending on the object to be polished in or on the first and second wafers.

The plurality of metal lines may include copper (Cu) or gold (Au). The metal coating may include Cu or Au, or another thermal conductor that is easily and substantially uniformly deposited on a substrate, such as aluminum (Al) or titanium (Ti).

At least one polishing pad of the first and second polishing pads may be a single pad, and the plurality of metal lines may be formed at the bottom side of the at least one polishing pad.

At least one polishing pad of the first and second polishing pads may comprise a stacked plurality of constituent pads including a top pad and a bottom pad, and in this case, the plurality of metal lines may be formed at the bottom side of the top pad, at the bottom side of the bottom pad, or at a place or location between the top pad and the bottom pad where the pads may be adhered to one another.

DETAILED DESCRIPTION OF THE EMBODIMENTS

Exemplary embodiments of the present invention will hereinafter be described in detail with reference to the accompanying drawings.

Figure 1:
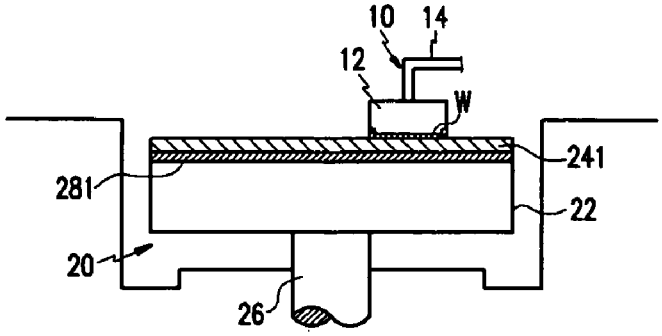
FIG. 1 is a schematic diagram of a CMP apparatus according to an exemplary embodiment of the present invention.
Figure 2:
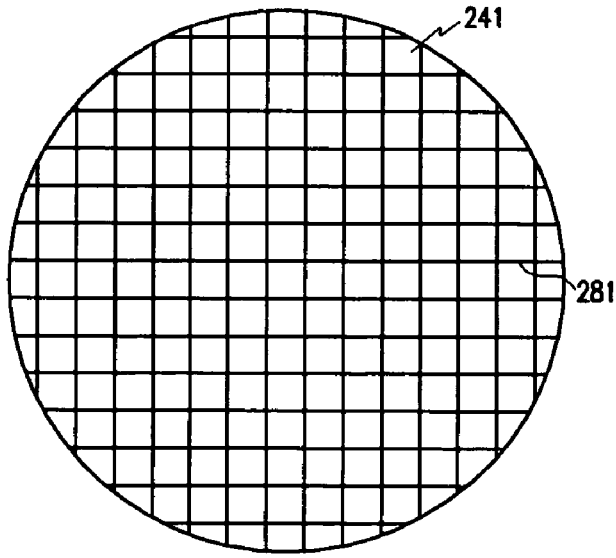
FIG. 2 shows a bottom view of a polishing pad in FIG. 1.

FIG. 1 is a schematic diagram of a CMP apparatus according to an exemplary embodiment of the present invention, and FIG. 2 shows a bottom view of a polishing pad in FIG. 1.

As shown in FIG. 1, a CMP apparatus according to the present exemplary embodiment includes a polishing head assembly 10 and a polishing station 20.

The polishing head assembly 10 includes a polishing head 12 holding a wafer W and an arm 14 connected with the polishing head 12.

Here, the polishing head 12 may fixedly hold the wafer W by vacuum, generated by a vacuum generator (not shown). In this case, the polishing head 12 may include a membrane, a retainer ring, and a carrier. Here, the membrane makes surface contact with a rear side of the wafer W and expands by compressed air supplied through a fluid hole of a carrier, and it thereby applies a force to the wafer W from its rearward. The retainer ring prevents the wafer W from moving away from the polishing head 12 during the polishing process. In addition, the membrane and the retainer ring may be installed at the carrier.

The polishing head 12 may be connected with an arm that loads and unloads the polishing head 12 to and from the polishing station 20 by a driving unit (not shown). Although an exemplary embodiment of the polishing head 12 has been described above, it should be understood that the present invention is not limited thereto. The polishing head 12 may be differently formed.

In addition, the polishing station 20 includes a platen 22 that rotates or is stationary, and a polishing pad 241 installed at the top of the platen 22 so as to polish the wafer W. Although not shown in the drawings, the polishing station 20 may further includes a slurry supply nozzle for supplying slurry to the polishing pad 241 and a conditioner for conditioning the polishing pad 241. Alternatively, the apparatus may include a polishing pad having a fixed abrasive therein, and the nozzle may be configured to supply only liquid-phase chemicals (e.g., deionized water, dilute acid, etc.), in which case the apparatus (and any method practiced thereon or therewith) may be simply a polishing apparatus (or method).

Reference numeral 26 shown in FIG. 1 indicates a rotation shaft that supports the platen 22.

In such a CMP apparatus, as shown in FIG. 2, a heat conduction medium 281 for enabling the temperature distribution of the polishing pad 241 to be uniform is formed at a bottom side of the polishing pad 241. In this case, the bottom side is generally the surface of the pad away or opposite from the surface of the pad making contact with and/or polishing the wafer.

The heat conduction medium 281 may be formed of a plurality of metal lines (for example, copper lines or gold lines) having thermal conductivity higher than that of the polishing pad 241, or it may be formed in the shape of a metal plate or coating. Such metal lines, coating or plating can be formed on the polishing pad by known techniques, such as evaporation and etching, printing or embossing using a conductive paste, conventional techniques used in the printed circuit board art for forming copper lines on circuit boards, etc.

The heat conduction medium 281 may be formed at a position other than the top side of the polishing pad 241, so that corrosion by cleaning water or a chemical such as one in the slurry may be reduced or prevented.

For example, when the polishing pad 241 is a single pad, the heat conduction medium 281 may be formed at the bottom side of the polishing pad 241 as shown in FIG. 1.

Figure 3:
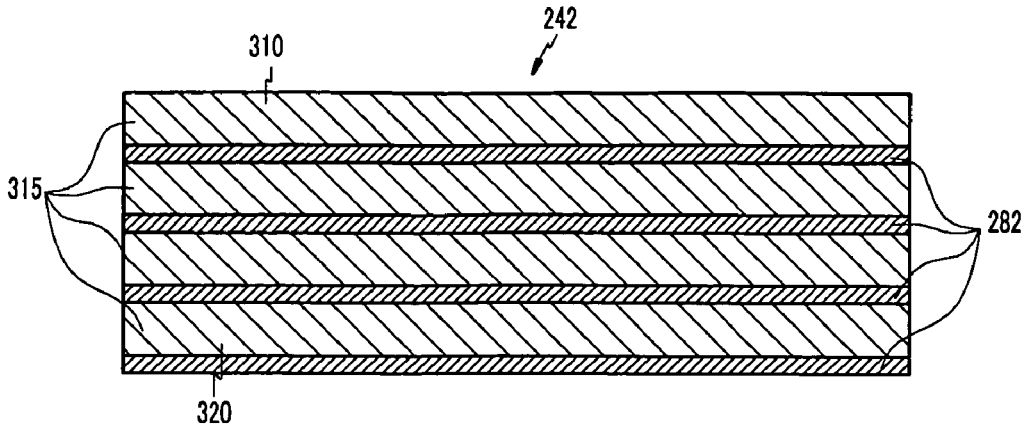
FIG. 3 shows a polishing pad formed in a type of stacked pad according to an exemplary embodiment of the present invention.
Figure 4:
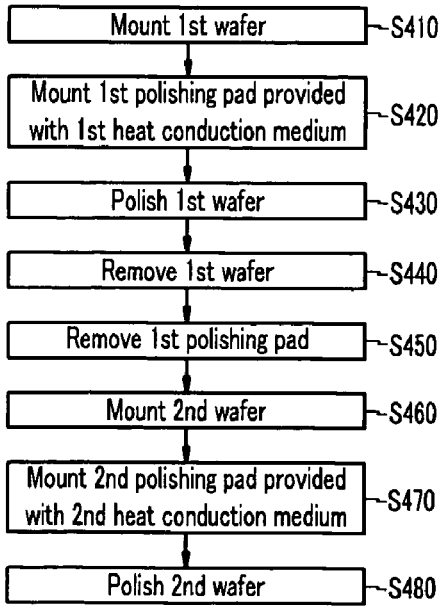
FIG. 4 is a flowchart showing a CMP method according to an exemplary embodiment of the present invention.

As another example, as shown in FIG. 3, a polishing pad 242 may be formed as a stacked pad having a plurality of constituent pads 315 including a top pad 310 and a bottom pad 320. In this case, a heat conduction medium 282 may be formed at the bottom side of the top pad 310, at the bottom side of the bottom pad 320, and/or at a place between the top pad 310 and the bottom pad 320 where the plurality of constituent pads 315 are adhered (i.e., where an adhesive is applied). Although FIG. 3 illustrates that the heat conduction medium 282 is formed at each place mentioned above, it should not be understood that the scope of the present invention is limited thereto.

In addition, the heat conduction mediums 281 and 282 (for example, metal lines) may be variously formed by changing an arrangement thereof, material thereof, line widths thereof, etc., depending on whether an object of the polishing (i.e., planarization) is an oxide layer or a metal layer, or depending on the type of targeted semiconductor product.

That is, the heat conduction medium 282 formed at the polishing pad 242 may be formed to be different from the heat conduction medium 281, in at least one of arrangements, structures, materials, and line widths of the plurality of metal lines.

Such a difference between the heat conduction mediums 281 and 282 may be designed depending on features of the wafer W to be polished, which will be obviously determined by a person of an ordinary skill in the art referring to specific details of the wafer to be polished.

Hereinafter, a CMP method according to an exemplary embodiment of the present invention for enabling such a merit will be described in detail.

The CMP method according to an exemplary embodiment of the present invention may be realized using a CMP apparatus according to an exemplary embodiment of the present invention.

That is, the CMP apparatus according to an exemplary embodiment of the present invention includes the polishing head 12 for holding a wafer and the platen 22 for holding a polishing pad for polishing the wafer.

In such a CMP apparatus, wafers may be subjected to a CMP process by changing polishing pads respectively formed with an appropriate heat conduction medium depending on the wafer to be polished.

In more detail, according to a CMP method according to an exemplary embodiment of the present invention, a first wafer to be polished is mounted at the polishing head 12 of the CMP apparatus at step S410.

In addition, at step S420, a first polishing pad 241 is mounted at the platen 22. A first heat conduction medium 281 for diffusing heat of the first polishing pad 241 is formed at the first polishing pad 241 such that a temperature distribution of the first polishing pad 241 may be substantially uniform.

By causing friction between the first wafer and the first polishing pad 241 mounted at the CMP apparatus, the first wafer is subjected to chemical mechanical polishing at step S430.

Subsequently, the first wafer is removed from the polishing head 12 of the CMP apparatus at step S440, and the first polishing pad 241 is removed from the platen 22 of the CMP apparatus at step S450.

Then at step S460, a second wafer to be polished is mounted at the polishing head 12 of the CMP apparatus.

In addition, at step S470, a second polishing pad 242 may be mounted at the platen 22. A second heat conduction medium 282 for diffusing heat of the second polishing pad 242 is formed at the second polishing pad 242 such that the temperature distribution of the second polishing pad 242 may be substantially uniform.

By causing friction between the second wafer and the second polishing pad 242 mounted at the CMP apparatus, the second wafer is subjected to a chemical mechanical polishing at step S480.

The first and second heat conduction mediums 281 and 282 may be differently formed depending on the object to be polished in the first and second wafers. In addition, the first and second heat conduction mediums 281 and 282 may be formed of a plurality of metal lines having thermal conductivity that is higher than the first and second polishing pads 241 and 242, respectively.

In a CMP method according to an exemplary embodiment of the present invention, the first polishing pad 241 may be formed as a single pad described with reference to FIG. 1, and the first heat conduction medium 281 formed thereat may be formed as shown in FIG. 2.

In addition, the second polishing pad 242 may comprise a stacked pad as shown in FIG. 3. Further, as has been described in connection with the CMP apparatus according to an exemplary embodiment of the present invention, the heat conduction medium 282 formed at or on the polishing pad 242 may be different from the heat conduction medium 281, in at least one of an arrangement, structure, material, and/or line width of the plurality of metal lines.

Such a difference between the heat conduction mediums 281 and 282 may be designed depending on the features of the wafer W to be polished, which will be obviously determined by a person of an ordinary skill in the art referring to specific details of the first and second wafers. For example, a metal surface (e.g., W) on the wafer may be polished with a pad having a different heat conduction medium than a wafer having an insulator (e.g., silicon dioxide) on the surface. The greater the dependence of the polishing rate for a given material on temperature, the more advantageous it becomes to employ a heat conduction medium that can provide a substantially uniform temperature distribution in a shorter period of time.

Regarding each of the first and second heat conduction mediums 281 and 282, the plurality of metal lines formed therein may be formed of a copper (Cu) or gold (Au) material.

In the above description, the first and second polishing pads 241 and 242 are described to be formed as a single pad and a stacked pad, respectively. However, it should not be understood that the present invention is limited thereto.

At least one polishing pad (that is, either or both) of the first and second polishing pads may be formed as a single pad, and in this case, the plurality of metal lines may be formed at the bottom side of the at least one polishing pad.

In addition, at least one polishing pad (that is, either or both) of the first and second polishing pads may be formed as a stacked pad having a plurality of constituent pads including a top pad and a bottom pad. In this case, the plurality of metal lines may be formed at the bottom side of the top pad, at the bottom side of the bottom pad, or at a place between the top pad and the bottom pad where the plurality of constituent pads are adhered to one another.

According to such a CMP apparatus, the heat generated at a central region of a wafer or polishing pad may be rapidly conducted to a peripheral region thereof (or vice versa), and thus the temperature distribution may be substantially uniform.

According to an exemplary embodiment of the present invention described above, the heat generated by friction with the wafer may be distributed somewhat uniformly over the entire polishing pad. Therefore, a removal rate difference of polishing between the central region and peripheral region due to temperature non-uniformity may be reduced or prevented, and thus, polishing uniformity may be improved.

Therefore, the thickness of the remaining layer after planarization may be relatively uniform. In addition, a process margin at a subsequent process (for example, a process for forming a contact or a via) may be increased, and thus yield and reliability of manufacturing a semiconductor device may be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A CMP apparatus, comprising:

a polishing head adapted to hold a wafer;

a platen;

a polishing pad on the platen, configured to polish the wafer; and a plurality of metal lines on the polishing pad arranged in parallel with the surface of the polishing pad, wherein the metal lines are in contact with each other, and the plurality of metal lines is adapted to diffuse, transfer or conduct heat of the polishing pad and provide a substantially uniform temperature distribution in the polishing pad.

2. The CMP apparatus of claim 1, wherein the plurality of metal lines having a thermal conductivity higher than that of the polishing pad.

3. The CMP apparatus of claim 2, wherein the plurality of metal lines comprise copper (Cu) or gold (Au).

4. The CMP apparatus of claim 2, wherein the polishing pad is a single pad, and the plurality of metal lines are at a bottom side of the polishing pad.

5. The CMP apparatus of claim 2, wherein: the polishing pad comprises a plurality of constituent pads including a top pad and a bottom pad; and the plurality of metal lines are at a bottom side of the top pad, a bottom side of the bottom pad, or at a place or location between the top pad and the bottom pad.

6. The CMP apparatus of claim 1, wherein the plurality of metal lines comprises Al or Ti.

7. The CMP apparatus of claim 1, wherein the plurality of metal lines comprises a pattern of first and second groups of parallel metal lines, the first group being perpendicular to the second group.

8. A CMP method using a CMP apparatus including a polishing head adapted to hold a wafer and a platen adapted to hold a polishing pad for polishing the wafer, the method comprising:

mounting a first wafer on the polishing head of the CMP apparatus;

mounting a first polishing pad on the platen, the first polishing pad having a first plurality of metal lines thereon or therein, arranged in parallel with the surface of the first polishing pad and in contact with each other, and adapted to diffuse or transfer heat in the first polishing pad such that a temperature distribution of the first polishing pad becomes substantially uniform;

applying a CMP process to the first wafer by polishing the first wafer with the first polishing pad;

removing the first wafer from the polishing head of the CMP apparatus;

removing the first polishing pad from the platen of the CMP apparatus;

mounting a second wafer on the polishing head of the CMP apparatus;

mounting a second polishing pad on the platen, the second polishing pad having a second plurality of metal lines thereon or therein, arranged in parallel with the surface of the second polishing pad and in contact with each other, and adapted to diffuse or transfer heat in the second polishing pad such that a temperature distribution of the second polishing pad becomes substantially uniform; and applying a CMP process to the second wafer by polishing the second wafer with the second polishing pad.

9. The CMP method of claim 8, wherein the first plurality of metal lines and the second plurality of metal lines are different in at least one of an arrangement, structure, material, and/or line width of the plurality of metal lines.

10. The CMP method of claim 9, wherein the first plurality of metal lines and the second plurality of metal lines each have a thermal conductivity that is higher than that of the first and second polishing pads, respectively.

11. The CMP method of claim 10, wherein the first and second plurality of metal lines comprise copper (Cu) or gold (Au).

12. The CMP method of claim 10, wherein at least one polishing pad of the first and second polishing pads is a single pad, and the corresponding first or second plurality of metal lines is at a bottom side of the at least one polishing pad.

13. The CMP method of claim 10, wherein: at least one polishing pad of the first and second polishing pads comprises a stacked plurality of constituent pads including a top pad and a bottom pad; and the corresponding first or second plurality of metal lines is at a bottom side of the top pad, a bottom side of the bottom pad, or at a place or location between the top pad and the bottom pad.

14. The CMP method of claim 8, wherein the plurality of metal lines comprises a pattern of first and second groups of parallel metal lines, the first group being perpendicular to the second group.

15. A polishing method, comprising: polishing a first wafer held by a polishing head of a polishing apparatus with a first polishing pad having a first plurality of metal lines therein or thereon, arranged in parallel with the surface of the polishing pad and in contact with each other, the first plurality of metal lines being configured or adapted to diffuse, transfer or conduct heat in the first polishing pad and provide a substantially uniform temperature distribution in the first polishing pad; and removing the first wafer from the polishing head of the CMP apparatus.

16. The method of claim 15, further comprising mounting the first wafer on the polishing head of the polishing apparatus; and mounting the first polishing pad on a platen of the polishing apparatus.

17. The method of claim 15, wherein the polishing apparatus comprises a chemical mechanical polishing apparatus, including the polishing head and a platen adapted to hold the polishing pad and polish the wafer.

18. The method of claim 15, further comprising: mounting a second wafer on the polishing head; and polishing the second wafer with the first polishing pad.

19. The method of claim 15, further comprising: removing the first polishing pad from the platen; and mounting a second polishing pad on the platen, the second polishing pad having a second plurality of metal lines therein or thereon, the second plurality of metal lines being configured or adapted to diffuse, transfer or conduct heat in the second polishing pad and provide a substantially uniform temperature distribution in the second polishing pad.

20. The method of claim 19, further comprising polishing a second wafer with the second polishing pad.

21. The method of claim 20, wherein the first plurality of metal lines and the second plurality of metal lines each have a thermal conductivity that is higher than that of the first and second polishing pads, respectively, and the first plurality of metal lines and the second plurality of metal lines are different in at least one of an arrangement, structure, material, and/or line width of the plurality of metal lines.

22. The method of claim 15, wherein the plurality of metal lines comprises a pattern of first and second groups of parallel metal lines, the first group being perpendicular to the second group.

* * * * *